US005789744A

United States Patent [19]

Spence et al.

[11] Patent Number: 5,789,744

[45] Date of Patent: Aug. 4, 1998

[54] METHOD FOR THE PRODUCTION OF ATOMIC ION SPECIES FROM PLASMA ION SOURCES

[75] Inventors: David Spence, Hinsdale; Keith Lykke, Woodridge, both of Ill.

[73] Assignee: The United States of America as represented by the United States Department of Energy, Washington, D.C.

[21] Appl. No.: 644,610

[22] Filed: Apr. 26, 1996

[51] Int. Cl.[6] ..... H05H 3/00

[52] U.S. Cl. ..... 250/251

[58] Field of Search ..... 250/251, 442.21; 315/111.81

[56] References Cited

U.S. PATENT DOCUMENTS 3,742,219 6/1973 Damm et al. ..... 250/251

4,584,473 4/1986 Hashimoto et al. ..... 250/251

5,654,541 8/1997 Outlaw et al. ..... 250/251

*Primary Examiner*—Kiet T. Nguyen

*Attorney, Agent, or Firm*—Lisa M. Soltis; Mark P. Dvorscak; William R. Moser

[57] ABSTRACT

A technique to enhance the yield of atomic ion species ($H^+$, $D^+$, $O^+$, $N^+$, etc.) from plasma ion sources. The technique involves the addition of catalyzing agents to the ion discharge. Effective catalysts include $H_2O$, $D_2O$, $O_2$, and $SF_6$, among others, with the most effective being water ($H_2O$) and deuterated water ($D_2O$). This technique has been developed at Argonne National Laboratory, where microwave generated plasmas have produced ion beams comprised of close to 100% purity protons ($H^+$) and close to 100% purity deuterons ($D^+$). The technique also increases the total yield of protons and deuterons by converting unwanted ion species, namely, $H_2^+$, $H_3^+$ and $D_2^+$, $D_3^+$, into the desired ion species, $H^+$ and $D^+$, respectively.

20 Claims, 4 Drawing Sheets

METHOD FOR THE PRODUCTION OF ATOMIC ION SPECIES FROM PLASMA ION SOURCES

CONTRACTUAL ORIGIN OF THE INVENTION

The United States Government has rights in this invention pursuant to Contract No. W-31-109-ENG-38 between the U.S. Department of Energy and the University of Chicago.

BACKGROUND OF THE INVENTION

This invention relates to an improved method for the production of atomic ion species ($H^+$, $D^+$) from gaseous plasma ion sources, and in particular to the enhanced production of atomic positive ions from electron cyclotron resonance (ECR) sources by the addition of specified catalysts. The invention is applicable to a wide range of processes using high current proton beams including: boron/neutron capture for cancer therapy; imaging for drug and explosives detection, and materials analysis; production of materials such as tritium; the destruction of radioactive waste; and for semiconductor chip manufacture. Additionally, the present invention is applicable to processes for the generation of other species of atomic positive ions from plasma ion sources such as $N^+$ or $O^+$. These species are commonly required for ion implantation in semiconductor devices, in reactive ion etching (RIE), and in surface modification of materials commonly used in the semiconductor industry.

Protons ($H^+$) or their deuterated analogs ($D^+$) for ion accelerators are usually produced in an ion source in which a plasma (ionized gas) is generated by the coupling of electrical energy into a gas ($H_2$ or $D_2$) which is fed into the ion source. Positively charged protons ($H^+$) or deuterons ($D^+$) are then extracted from the ion source by means of suitable electric fields which penetrate into the ion source through an extraction aperture.

In addition to protons or deuteron ions, all such sources built or conceived to date also generate the minority ion species $H^+_2$ and $H^+_3$ or $D^+_2$ and $D^+_3$ in significant amounts. These minority species are sometimes unacceptable impurities for certain types of accelerators.

Gaseous plasma ion sources can be generically broken down into several principal types. The most commonly used types include:

- Electron Cyclotron Resonance (ECR) sources in which the plasma is generated by resonantly coupling microwave energy (usually in the gigahertz (Ghz) frequency range) into the ion source.
- Penning type sources in which the plasma is generated by striking a direct current (DC) discharge between a suitably shaped anode and cathode (which may or may not be externally heated).
- Direct current (DC) driven volume sources (sometimes called bucket sources) in which an electric arc is struck between heated filaments and an anode.
- Radio frequency (RF) driven volume sources (also sometimes referred to as bucket sources) in which radio frequency energy (usually in the few Megahertz (Mhz) frequency range) is coupled to the gas in the ion source by a suitably configured antenna.

High current cw proton sources of high reliability are a current requirement for several proposed accelerator applications, including spallation neutron sources and accelerator production of tritium. A desirable property of such sources is that the proton fraction and current of the extracted beam be as high as possible. This avoids the need for selection of the desired ion, i.e., to enable direct injection into an accelerating structure. A number of sources yield proton faction of the order of 75 to 80% of the extracted beam, the other unwanted beam components being $H_2^+$ and $H_3^+$. These advanced sources include the arc-driven multicusp generator developed for the Basic Technology Accelerator (BTA) at the Japanese Atomic Energy Research Institute (JAERI), and the high pressure ECR source developed at Chalk River Laboratories (CRL). Although the CRL source has generated a beam with a proton fraction under resonant conditions of 90%, most experiments reported by the CRL group have been performed with proton fractions of 75% to 80% while operating off-resonance, normal operations for this source. This appears to be caused by problems in maintaining long term plasma stability when operating on resonance. Similarly, the CRL ECR source supplied to Los Alamos National Laboratory (LANL) generally produces beams with a proton fraction of about 75 to 80%. While beams with a proton fraction of 80% have been shown by the CRL group to be suitable for direct injection into a room-temperature radio frequency quadruple (RFQ), they would not be suitable for injection into a superconducting structure because of the possible unacceptable thermal loading caused by the deleterious $H_2^+$ and $H_3^+$ ion species. Unless beam purities of close to 99% or so can be achieved, direct injection into a superconducting structure does not appear likely, thus requiring magnetic separation before injection. Magnetic separation inevitably leads to emittance growth and loss of beam brightness, a situation that is also undesirable for high current cw superconducting accelerators. An additional major benefit of very high purity proton beams is the higher the proton fraction, the less is the effective mass of the beam. Hence, for a given beam current density, the electric field can be reduced, thus reducing voltage breakdown and yielding a more reliable injector.

It has long been known that the addition of minor constituents to microwave generated plasmas can greatly modify the species composition of the plasma, and increase atomic neutral fractions with respect to molecular species. This technique has sometimes been used in atomic and molecular physics to produce high purity neutral atomic hydrogen beams. Because the molecular fraction of the additive required is generally so small (<1%), it seems unlikely that its catalytic action is a gas phase property. Rather it is more likely that it results from some surface action.

Systematic studies of atomic hydrogen fractions from microwave driven plasmas, however, strongly indicate that any catalytic action of the additive results from largely unknown surface phenomena by preventing atomic recombination on the surface. This is analogous to the prevention of recombination by fused-alumina ion source liners. Neutral atomic hydrogen sources with close to 100% purity have been made using this technique, leading us to recognize that this may be a viable technique for the production of high purity ion beams.

Accordingly, it is an object of the present invention to increase the yield of neutral atomic species from plasmas.

Another object of the present invention is the production of essentially pure $H^+$ or $D^+$ beams through the addition of catalytic additives to a plasma in the plasma ion source.

Yet a further object of the present invention is to control the generation of unwanted species of ions ($H_2^+$, $H_3^+$, $D_2^+$, $D_3^+$) in an ion source by adding water or deuterated water such that only atomic neutral species ( H or D) exist in the source in appreciable quantities and from which only pure proton or deuteron ion species can be produced and thus extracted as an ion beam.

SUMMARY OF THE INVENTION

A method for enhancing the yield of atomic ion species from a plasma ion source according to the present invention can include: generating the plasma by coupling electrical energy to a gas fed into the ion source; controlling the generation of impure ion species in the plasma by introducing a catalyzing agent into the plasma such that the presence of the agent causes only atomic neutral species to be produced in the volume of the plasma ion source; and, then extracting pure ion species as an ion beam from the source. The plasma can be hydrogen or deuterium, and the introduction of the catalyzing agent causes only essentially pure proton ($H^+$) beams, or pure deuteron ($D^+$) beams, respectively, to be produced.

An alternative method for increasing the proton fraction extracted from a plasma ion source can provide: generating the plasma by the coupling of electrical energy into a gas of $H_2$ which is fed into the ion source; controlling the generation of minority ion species of $H_2$ (i.e. $H_2^+$ and $H_3^+$) by introducing a catalyzing agent into the plasma such that the presence of the agent causes only atomic neutral species of H to exist in the source; and, extracting only pure proton $H^+$ beams from the source. To extract only pure deuteron $D^+$ beams, the generated gas would be $D_2$, and the catalyzing agent would control the generation of minority ion species of $D_2$ (i.e. $D_2^+$ and $D_3^+$) so that only atomic neutral species of D would exist in the source, and extracting only pure $D^+$ beams from the plasma ion source. To extract pure proton beams, the catalyzing agent is water ($H_2O$), and to extract pure deuteron beams, the catalyzing agent is deuterated water ($D_2O$).

BRIEF DESCRIPTION OF THE DRAWINGS

The above-mentioned and other features of the invention will become more apparent and be best understood, together with the description, by reference to the accompanying drawings, in which.

DESCRIPTION OF THE PREFERRED EMBODIMENTS

Figure 1:
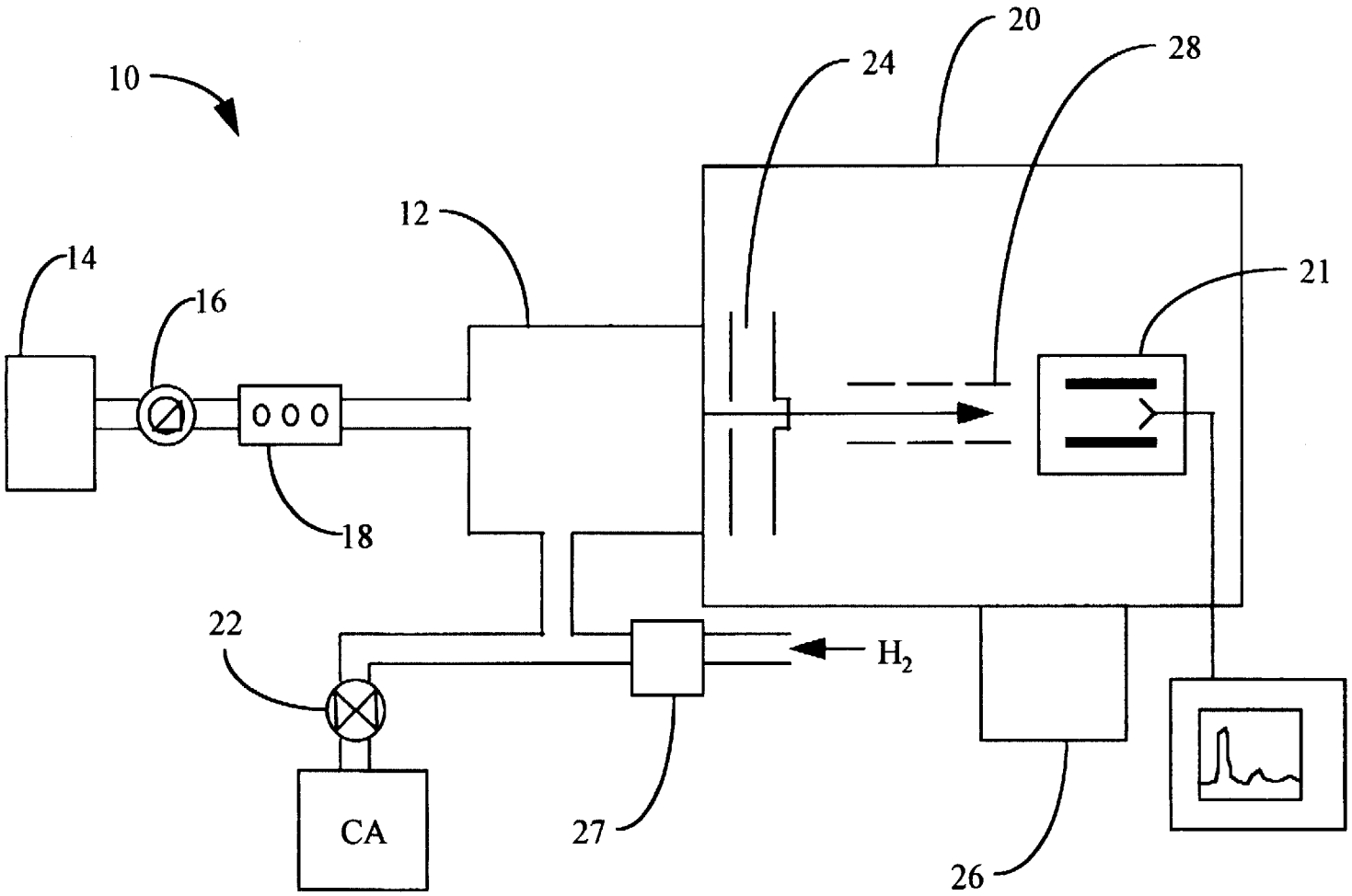
FIG. 1 shows a schematic diagram of an apparatus that can be used to generate high purity cw (continuous wave, i.e. not pulsed) proton beams in accordance with the present invention.

There are two principal mechanisms for the production of positive atomic ions ($H^+$, $D^+$) in ion sources of the type described above. The first is direct electron impact ionization of the molecular species ($H_2$, $D_2$) in the ion chamber:

$$H_2+e \rightarrow H^++H+2e \text{—dissociative ionization} \quad (1)$$

or $$H_2+e \rightarrow H^++H^-+e \text{—ion pair production} \quad (2)$$

A second mechanism is a two step process in which the molecular species ($H_2$, $D_2$) is first dissociated by electron impact:

$$H_2+e \rightarrow H+H+e \quad (3)$$

followed by direct electron impact ionization of the atomic species:

$$H(D)+e \rightarrow H^+(D^+)+2e \quad (4)$$

The process shown in equation (4) is generally the dominant mechanism for production of protons ($H^+$) or deuterons ($D^+$) in plasma ion sources.

In addition to the production of $H^+$ or $D^+$ in ion sources, the molecular ions $H_2^+$ and $H_3^+$ or $D_2^+$ and $D_3^+$ can be produced by the following reactions:

$$e+H_2 \rightarrow H_2^++2e \quad (5)$$

and $$H_2^++H_2 \rightarrow H_3^++H \quad (6)$$

These molecular ions are often unacceptable impurities for ion beam accelerators. Obviously, any mechanism which depletes or enhances the concentration of hydrogen atoms (H) or deuteron atoms (D) in the ion source will either reduce or enhance the concentration of atomic ions ($H^+$, $D^+$) in the extracted ion beam by way of equation (4) above.

Though various gas phase mechanisms can result in the depletion of atomic species (H,D) in ion sources, at the gas pressures commonly used in ion sources, the principal depletion mechanism is by atom—atom (H—H, D—D) recombination on the metal walls of the source, i.e., $$H(D)+H(D)+M \rightarrow H_2(D_2)+M$$

where M is the metal wall which absorbs the energy given out in the recombination process. The efficiency with which recombination occurs on surfaces is given by what is known as the recombination coefficient. The higher the recombination coefficient, the greater is the loss of atomic species (H,D) from the plasma and hence the greater the depletion of atomic ions ($H^+$, $D^+$) in the extracted ion beam.

It has been known and understood qualitatively and quantitatively for several decades that the atomic fraction (H,D) in plasmas can be enhanced by reducing the wall recombination coefficient. This is generally achieved by lining the walls of the discharge chamber with insulating materials that have low recombination coefficients. Examples of some effective materials include ceramics (aluminum oxide, aluminum nitride, etc.) quartz, and glass. These techniques have been confined to those who wish to generate beams of neutral atomic species (H, D, O, N, etc.) rather than ionic species. Recently, Chalk River Nuclear Laboratory (CRNL) has applied this insulated lining teclmology to an ECR ion source and has achieved significant enhancement of atomic ionic species ( $H^+$, $D^+$) from their source, up to 90% of the ions extracted being of the atomic ion species under resonant conditions and 75 to 80% under more usual non-resonant operating conditions.

However, an additional technique to enhance the yield of neutral atomic species (H,D, O, N, etc.) from plasmas is the subject of the present invention. Essentially, the technique involves the addition of catalyzing agents to the ion discharge. Effective catalysts include $H_2O$, $O_2$, and $SF_6$, among others, with the most effective being water ($H_2O$). This technique has been developed at Argonne National Laboratory, where microwave produced beams consisting essentially of 100% atomic neutral species (H) have been generated. Obviously, if nothing but atomic species (H) is being extracted from the source, then nothing but atomic species (H) can exist in the source.

The addition of small quantities of water ($H_2O$) to a hydrogen plasma will create conditions in the plasma such that essentially only atomic species (H) are present and from which only atomic ionic species ($H^+$) can be generated and extracted, thus producing pure proton beams:

$$H_2O+[e+H_2]\rightarrow e+H+H\rightarrow H^+ \quad (7)$$

Similarly, the addition of deuterated water ($D_2O$) to deuterium ($D_2$) will produce essentially pure deuteron ion ($D^+$) beams:

$$D_2O+[e+D_2]\rightarrow e+D+D\rightarrow D^+ \quad (8)$$

Other catalytic additives, such as oxyge n ($O_2$), and sulfir hexaflouride ($SF_6$) will also enhance the purity of $H^+$ or $D^+$, though to a lesser degree.

It is to be expected that the $H^+$ and $D^+$ enhancement from $H_2O$ and $D_2O$ additives to be greatest in ECR type sources (with or without insulating linings). The enhancements will also be expected in any type of ion source in which the ions are generated in a plasma, specifically Penning type sources and arc driven and RF driven volume sources.

It should also be mentioned that the enhancement of other species of atomic positive ions from plasma ion sources may be achieved by the addition of the above-mentioned catalysts. The yield of nitrogen ($N^+$) and oxygen ($O^+$) may be significantly enhanced by the addition of $H_2O$ to the ion source. Such ions are commonly required for ion implantation in semiconductor devices and in the reactive ion etching (RIE) and surface modification of materials commonly used in the semiconductor industry.

Referring to FIG. 1, an apparatus 10 for increasing the proton fraction extracted from a plasma ion source is schematically shown. The apparatus includes an electron cyclotron resonance (ECR) source 12 powered by a 2.45 GHz microwave generator 14 rated at 2.0 kW. The microwave generator 14 is coupled to the source 12 via a circulator 16 and a four-stub autotuner 18. The ion source 12 is attached to a large, flexibly designed, high-vacuum, oil-free diagnostic chamber 20 that is pumped by three cryopumps 26 and a turbo pump giving a base pressure of $1.0\times10^{-8}$ torr without baking. The chamber 20 includes a quadrupole mass spectrometer 21. When operating the ion source at a hydrogen-feed flow rate of 1 standard cubic centimeter per minute (sccm), the base pressure in the diagnostic chamber rises to about $6\times10^{-6}$ torr as measured on an (uncorrected) ion gauge. The catalytic additive, here $H_2O$, and designated as "CA", is introduced to the plasma downstream of the hydrogen flow control unit 27 via a leak valve 22 as shown in FIG. 1. The molecular fraction $H_2O/H_2$ is estimated from the ion gauge measurements taking into account the very different gauge constants for these two gases. This fraction is generally of the order of 1% or less and the ion gauge measurements are consistent with the fraction of $O^+$ seen in the extracted beam as described below.

As an example, 5 to 15 mA of beam current is extracted from the source at a few hundred volts by an accel-decel arrangement 24, with the main beam being collected and monitored on the decel electrode. A small hole in the decel electrode allows a portion of the beam to be imaged at the entrance plane of a quadrupole mass spectrometer (QMS) by means of a three element zoom lens 28. The zoom lens gradually decelerates the beam which emerges from the decel electrode to the 10–20 eV required by the QMS for quantitative analysis. The beam trajectories for the zoom lens were calculated using the computer software code SIMION.

Figure 2:
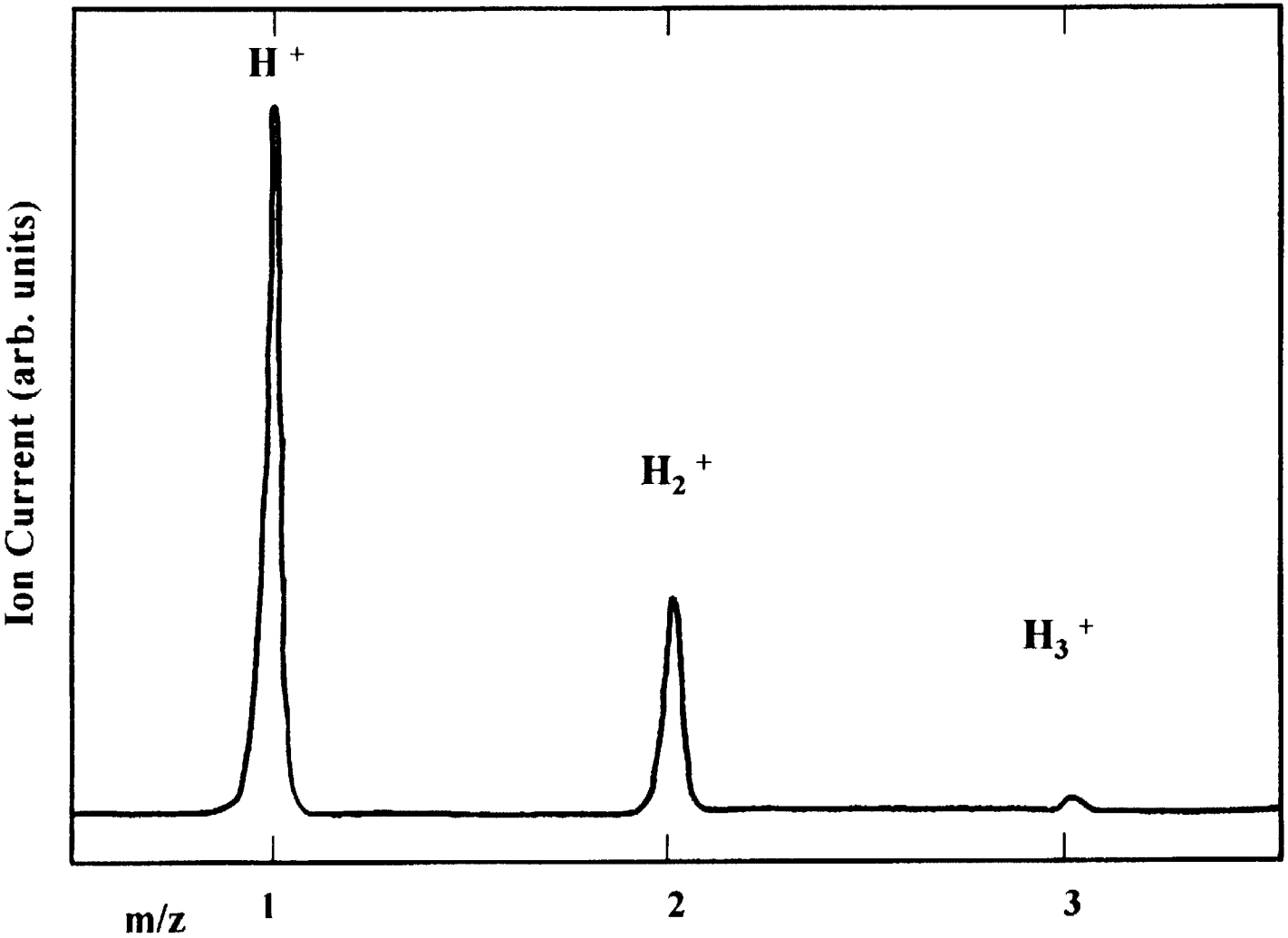
FIG. 2 shows the mass analysis of a beam extracted from an ion source with 1 standard cubic centiminute (sccm) $H_2$ flow and 700 W microwave power to the source.

FIG. 2 shows the mass analysis of a beam extracted with 1 sccm $H_2$ flow and 700 W microwave power to the source. Under these conditions, the proton fraction ($H^+$) of the total beam(consisting of $H^+$, $H_2^+$, $H_3^+$) is about 0.75.

Figure 3:
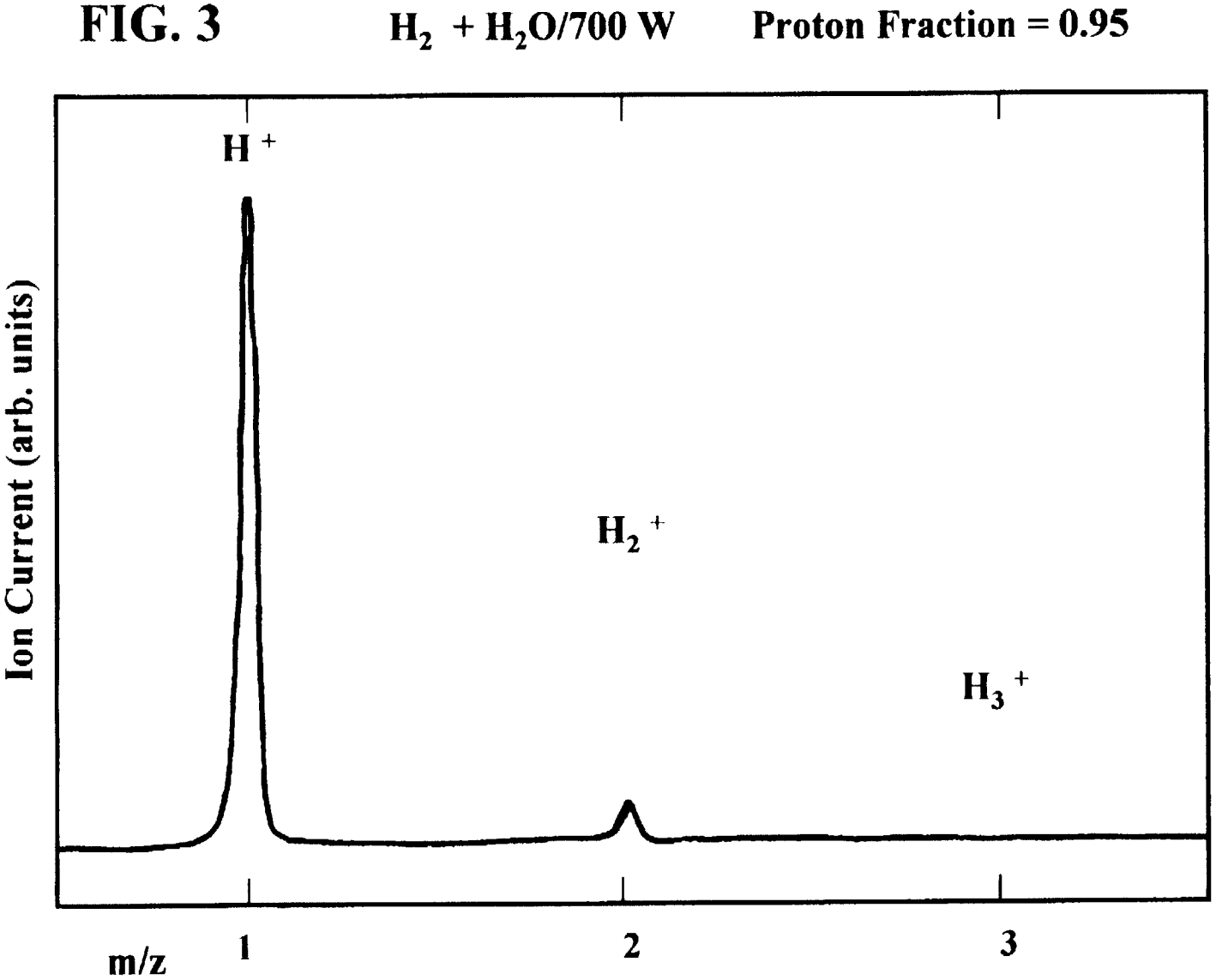
FIG. 3 shows a beam composition obtained under the same conditions as FIG. 2, but with ~1% $H_2O$ added to the source; and, FIG. 4 shows the proton fraction obtained as a function of microwave power to the source for 1 (sccm) $H_2$ flow rate; both with (solid circles) and without (solid squares) $H_2O$ additive and operating under non-resonant conditions.

FIG. 3 shows a beam composition obtained under the same conditions as FIG. 2, but with ~1% $H_2O$ added to the source. In this case the proton fraction is slightly higher than 0.95. Notable in FIG. 3 is the absence of $H_3^+$. This is expected since $H_3^+$ is produced by via the reaction of equation (6) above, and is thus quadratic with respect to the $H_2$ partial pressure in the source. Reduction of the $H_2^+$ peak by a factor of about 5 by the addition of 1% $H_2O$ thus reduces the $H_3^+$ intensity by a factor of 25. The increase in concentration of hydrogen atoms in the source by the addition of $H_2O$ is dramatically visual to the eye, the plasma changing color from pale bluish-pink to a dramatic deep violet characteristic of Balmer-Alpha radiation. The addition of $H_2O$ to the source appears to have the added benefit of significantly stabilizing the plasma and producing a less noisy beam. Also, significantly higher absolute proton currents can be extracted from the source because the $H_2^+$ and $H_3^+$ impurity ions are converted into the useful $H^+$ species. A similar benefit results from the addition of $D_2O$ to produce $D^+$ species.

Figure 4:
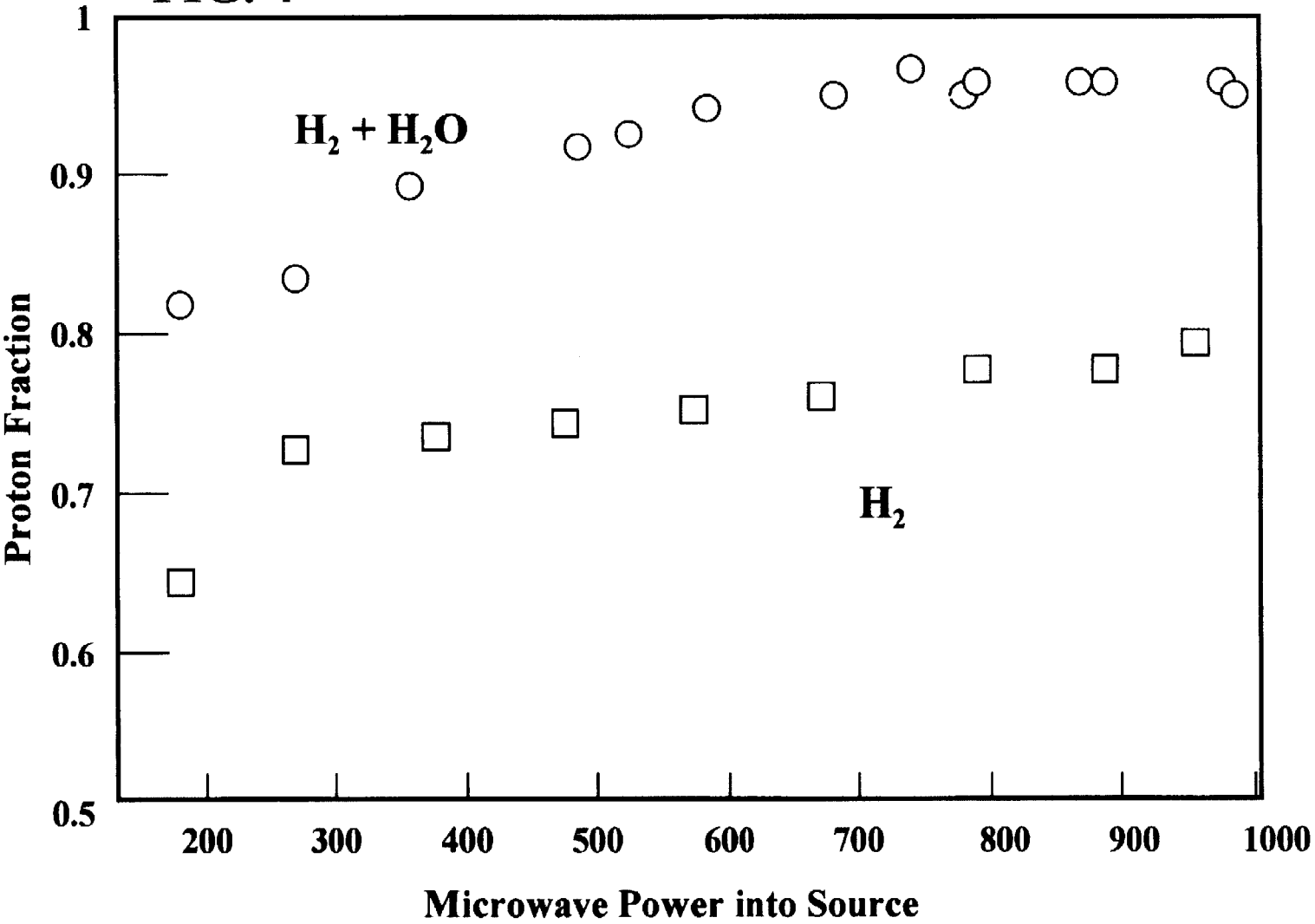

FIG. 4 shows the proton fraction obtained as a function of microwave power to the source for 1 sccm $H_2$ flow rate, both with (solid circles) and without (solid squares) $H_2O$ additive and operating under non-resonant conditions. Alternate data points in FIG. 4 were taken under conditions of increasing and decreasing power so as to illustrate the absence of any long term drift.

Under the conditions of FIG. 4, measurements of other impurities introduced into the beam by admitting $H_2O$ to the source show these to be $O^+$ at the level of 4 parts per thousand (ppt) and $OH^+$+$H_2O$ each at the level of much less than 1 ppt. Finally, we have obtained similar results in deuteron ($D^+$) enhancement by use of either $H_2O$ or $D_2O$, each being equally effective but producing extraneous peaks ($H^+$, $HD^+$ and $HD_2^+$) in the case of $H_2O$+$D_2$.

There has thus been described a method for the significant enhancement in the proton and deuteron fractions of beams extracted from high pressure ECR sources by the addition of about 1% of $H_2O$ or $D_2O$ to the source under non-resonant conditions. An additional benefit is a more stable operation of the source and increased current of the useful $H^+$ and $D^+$ species. The technique may be applied to any type of gas discharge proton source, provided that the source may be made to operate thermally cool so as to prevent desorption of the catalytic additive. With minor modifications, the source may realistically yield proton fractions of 98 to 99%, the remaining part consisting only of $O^+$, $OH^+$, and $H_2O$+ resulting from the $H_2O$.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described to best explain the principles of the invention and its practical application and thereby enable others skilled in the art to best utilize the invention in various embodiments and with various modifications as are suited to the particular use contemplated. It is intended that the scope of the invention be defined by the claims appended hereto.

The embodiments of the invention in which an exclusive property of privilege is claimed are defined as follows:

1. A method for enhancing the yield of atomic neutral species generated in a plasma ion source, such that ion beams comprised of essentially pure atomic ion species are available, comprising:

a) generating a plasma by coupling electrical energy to a gas fed into the plasma ion source;

b) controlling the generation of impure minority ion species in the plasma ion source by introducing a catalyzing agent into the plasma ion source, such that the presence of the agent causes primarily atomic neutral species to be produced in the plasma ion source;

c) extracting essentially pure atomic ion species as an ion beam from the plasma ion source; and d) increasing the extracted current of the desired atomic ion species.

2. The method of claim 1 wherein the gas is $H_2$ and the catalyzing agent controls the generation of minority ion species of $H_2$ such that primarily atomic neutral species of H exist in the plasma ion source, and essentially pure proton $H^+$ beams are extracted from the plasma ion source.

3. The method of claim 2 wherein the catalyzing agent is water ($H_2O$).

4. The method of claim 1 wherein the gas is $D_2$, the catalyzing agent controls the generation of minority ion species of $D_2$ such that primarily atomic neutral species of D exist in the plasma ion source, and essentially pure deuteron $D^+$ beams are extracted from the plasma ion source.

5. The method of claim 4 wherein the catalyzing agent is deuterated water ($D_2O$).

6. The method of claim 1 wherein generating the plasma and controlling the generation of impure ion species in the plasma ion source by introducing a catalyzing agent into the plasma ion source comprises performing the reaction:

$$H_2O+[e+H_2]\rightarrow e+H+H\rightarrow H^+$$

wherein $H_2O$ is the catalyzing agent, $H_2$ is the gas and the extracted ion beam is comprised of essentially pure $H^+$.

7. The method of claim 1 wherein generating the plasma and controlling the generation of impure ion species in the plasma ion source by introducing a catalyzing agent into the plasma ion source comprises performing the reaction:

$$D_2O+[e+D_2]\rightarrow e+D+D\rightarrow D^+$$

wherein $D_2O$ is the catalyzing agent, $D_2$ is the gas, and the extracted ion beam is comprised of essentially pure $D^+$.

8. The method of claim 1 wherein the catalyzing agent is selected from the group consisting of $H_2O$, $D_2O$, $O_2$, and $SF_6$.

9. The method of claim 1, wherein the ratio of catalyzing agent to the gas in the plasma ion source is less than about 1:100.

10. A method for producing atomic ion species from a plasma ion source comprising:

a) generating a plasma in the plasma ion source; and b) introducing a catalyzing agent into the plasma ion source to control the generation of impure ion species in the plasma ion source, such that the presence of the catalyzing agent causes primarily atomic neutral species to be produced in the plasma ion source, whereby essentially pure atomic ion species are extractable.

11. The method of claim 10 wherein the step of generating the plasma includes coupling energy into a gas fed plasma ion source.

12. The method of claim 11 wherein the energy is electrical energy, including microwave energy.

13. The method of claim 11 wherein the energy is radio frequency energy.

14. The method of claim 11 wherein the gas is molecular and selected from the group consisting hydrogen, deuterium, oxygen, and nitrogen.

15. The method of claim 11 wherein the ratio of catalyzing agent to the gas in the plasma ion source is less than about 1:100.

16. The method of claim 11 wherein the gas is $H_2$, the catalyzing agent is $H_2O$, and the extracted atomic ion species is $H^+$.

17. The method of claim 11 wherein the gas is $D_2$, the catalyzing agent is $D_2O$, and the extracted atomic ion species is $D^+$.

18. The method of claim 10 wherein the catalyzing agent is selected from the group consisting of $H_2O$, $D_2O$, $O_2$, and $SF_6$.

19. The method of claim 10 wherein the impure ion species are $H_2^+$, $H_3^+$, or a combination thereof, and wherein the catalyzing agent converts the impure ion species into $H^+$, thereby increasing the yield of the atomic ion species.

20. The method of claim 10 wherein the impure ion species are $D_2^+$, $D_3^+$, or a combination thereof, and wherein the catalyzing agent converts the impure species into $D^+$, thereby increasing the yield of the atomic ion species.

* * * * *